US008956467B2

(12) United States Patent
Obayashi et al.

(10) Patent No.: US 8,956,467 B2
(45) Date of Patent: Feb. 17, 2015

(54) COMPOSITE STEEL PART AND MANUFACTURING METHOD FOR THE SAME

(75) Inventors: Koji Obayashi, Toyoake (JP); Mamoru Takeuchi, Kariya (JP); Ryuta Sugiyama, Anjo (JP); Ken Shimizu, Toyota (JP); Koichi Kato, Anjo (JP)

(73) Assignee: Aisin AW Co., Ltd., Anjo (JP)

( * ) Notice: Subject to any disclaimer, the term of this patent is extended or adjusted under 35 U.S.C. 154(b) by 329 days.

(21) Appl. No.: 13/441,404

(22) Filed: Apr. 6, 2012

(65) Prior Publication Data

US 2012/0267009 A1 Oct. 25, 2012

(30) Foreign Application Priority Data

Apr. 22, 2011 (JP) ..... 2011-096433

(51) Int. Cl.

| | |
|---|---|
| ***C23C 8/22*** | (2006.01) |
| ***C23C 8/02*** | (2006.01) |
| ***C23C 8/20*** | (2006.01) |
| ***C23C 8/80*** | (2006.01) |
| ***C21D 1/06*** | (2006.01) |
| ***C21D 1/25*** | (2006.01) |

(52) U.S. Cl.

CPC ... *C23C 8/02* (2013.01); *C23C 8/20* (2013.01); *C23C 8/22* (2013.01); *C23C 8/80* (2013.01); *C21D 1/06* (2013.01); *C21D 1/25* (2013.01); *C21D 2211/002* (2013.01); *C21D 2211/008* (2013.01); *C21D 2211/009* (2013.01)

USPC ..... 148/211; 148/319

(58) Field of Classification Search

CPC ..... C21D 9/085

USPC ..... 148/211, 319

See application file for complete search history.

(56) References Cited

U.S. PATENT DOCUMENTS

| | | | |
|---|---|---|---|
| 6,153,030 | A | 11/2000 | Hanisch et al. |
| 7,988,796 | B2 | 8/2011 | Ohbayashi et al. |

FOREIGN PATENT DOCUMENTS

| | | |
|---|---|---|
| JP | A-01-127661 | 5/1989 |
| JP | A-08-041531 | 2/1996 |
| JP | A-2000-063952 | 2/2000 |
| JP | A-2002-167658 | 6/2002 |
| JP | A-2005-076866 | 3/2005 |
| JP | A-2008-069422 | 3/2008 |

OTHER PUBLICATIONS

International Search Report issued in International Application No. PCT/JP2012/056967 (with translation).

*Primary Examiner* — Jessee Roe

(74) *Attorney, Agent, or Firm* — Oliff PLC

(57) ABSTRACT

A manufacturing method for a composite steel part including preparing an intermediate product in which an extra portion, which has a thickness equal to or more than that of a carburized layer to be formed in a subsequent carburizing step, has been added to a welding expected portion, carburizing the intermediate product by heating to an austenitizing temperature or more in a carburizing atmosphere, then cooling the intermediate product at a cooling rate less than a rate at which martensitic transformation occurs and without completing structural transformation due to the cooling, quenching a portion of the intermediate product after heating to an austenitizing range by high-density energy and thereafter cooling to cause martensitic transformation to form a carburized quenched portion, removing an extra portion of the intermediate product; and then welding a second steel part to the welding expected portion.

2 Claims, 13 Drawing Sheets

COMPOSITE STEEL PART AND MANUFACTURING METHOD FOR THE SAME

INCORPORATION BY REFERENCE

The disclosure of Japanese Patent Application No. 2011-096433 filed on Apr. 22, 2011 including the specification, drawings and abstract is incorporated herein by reference in its entirety.

BACKGROUND OF THE INVENTION

The present invention relates to a composite steel part including both a carburized quenched portion and a welded portion, and to a manufacturing method for the composite steel part.

DESCRIPTION OF THE RELATED ART

A part called a sleeve pump impeller extension is an example of steel parts to be incorporated in an automotive automatic transmission. The steel part is, as it were, a composite steel part fabricated by welding a first steel part, which includes a cylindrical portion formed in a cylindrical shape and a flange portion provided to extend radially outward from one end of the cylindrical portion, and a second steel part to each other at the flange portion. The outer peripheral surface of the cylindrical portion of the first steel part serves as a sliding surface, and therefore the cylindrical portion has been subjected to a carburizing quenching process in order to improve wear resistance.

On the other hand, the flange portion of the above first steel part includes a welding expected portion to be welded to the second steel part, and it is desired that the welding expected portion should not be subjected to a carburizing process in order to secure weldability.

Therefore, the above first steel part according to the related art is manufactured by the following complicated manufacturing method. That is, a steel material with a relatively low carbon content is used as a raw material, and is subjected to forging and cutting steps to obtain a steel part formed in a shape close to that of the final product. Then, an anti-carburizing process in which a welding expected portion of the steel part is covered with an anti-carburizing agent is performed. Then, the steel part is subjected to a carburizing process in a gas carburizing furnace, oil-quenched immediately thereafter, and subjected to a tempering process. After that, shot blasting is performed on the anti-carburized portion to remove the anti-carburizing agent. Finally, a finishing step such as polishing and washing is performed to obtain the first steel part. After that, the first steel part and a second part are welded to each other to obtain the final composite steel part.

A general method for the anti-carburizing process etc. is described in Japanese Patent Application Publication No. 2005-76866 (JP 2005-76866 A), for example.

SUMMARY OF THE INVENTION

In the manufacturing method according to the related art for the above composite steel part, as discussed above, in manufacturing the first steel part, it is necessary to perform the carburizing process after performing the anti-carburizing process in which the anti-carburizing agent is applied to the welding expected portion, and to thereafter perform the anti-carburizing agent removal step. The anti-carburizing process and the anti-carburizing agent removal process involve a significantly large number of man-hours to result in a cost increase. In the case where the anti-carburizing process is omitted, on the other hand, the amount of carbon in the raw material of the welding expected portion may be increased to disadvantageously cause a weld crack during welding. Thus, the anti-carburizing process may not be simply omitted.

It is also conceivable to use a steel material with a relatively high carbon content in order to dispense with the carburizing treatment step and perform only quenching. However, it is difficult to significantly increase the carbon content from the viewpoint of workability, and the carbon concentration on the surface may not be made so high as in the case where carburization is performed. Therefore, the hardness improving effect of the quenching is low, and desired wear resistance may not be obtained.

The present invention has been made against such background, and has an object to provide a manufacturing method for a composite steel part that can achieve a sufficient effect of improving the surface hardness of a part that requires wear resistance, that can improve the characteristics of a welded portion more than ever, and that can completely abolish an anti-carburizing process during manufacture.

A first aspect of the present invention provides a manufacturing method for a composite steel part formed by welding a plurality of steel parts to each other, which includes: manufacturing a first steel part, which includes a cylindrical portion formed in a cylindrical shape and a flange portion provided to extend radially outward from one end of the cylindrical portion, the cylindrical portion being a carburized quenched portion which has been subjected to a carburizing quenching hardening process and the flange portion including a welding expected portion to be welded to a second steel part, by preparing an intermediate product in which an extra portion, which has a thickness equal to or more than that of a carburized layer to be formed in a subsequent carburizing step, has been added to the welding expected portion, and performing the carburizing step in which the intermediate product is heated to an austenitizing temperature or more in a carburizing atmosphere to form the carburized layer on a surface of the intermediate product, a cooling step, subsequent to the carburizing step, in which the intermediate product is cooled at a cooling rate less than a cooling rate at which martensitic transformation is caused and in which the intermediate product is cooled to a temperature equal to or less than a temperature at which structure transformation due to the cooling is completed, a quenching step in which a desired portion of the cylindrical portion of the intermediate product is heated to an austenitizing range by high-density energy and thereafter cooled at a cooling rate equal to or more than the cooling rate at which martensitic transformation is caused to form the carburized quenched portion in the desired portion, and a cutting step in which the extra portion of the intermediate product is cut; and then performing a welding step in which the second steel part is brought into abutment with the welding expected portion of the flange portion of the obtained first steel part to weld the first steel part and the second steel part to each other.

A second aspect of the present invention provides a composite steel part formed by welding a plurality of steel parts to each other, wherein: a first steel part includes a cylindrical portion formed in a cylindrical shape and a flange portion provided to extend radially outward from one end of the cylindrical portion; the cylindrical portion is formed by a carburized quenched portion in which a surface layer portion has a martensite structure and an inner portion has a bainite structure; the flange portion includes a welded portion welded to a second steel part; the welded portion includes a melt/ resolidificated portion and a heat-affected portion provided adjacent to the melt/resolidificated portion; and the melt/resolidificated portion has a martensite-bainite-pearlite structure, and the heat-affected portion has a bainite-ferrite-pearlite structure.

In the manufacturing method according to the above first aspect, the carburizing step and the cooling step described above are performed using the intermediate product including the above extra portion. After that, the above quenching step is performed locally on the portion which is to become the carburized quenched portion, and the cutting step is performed to remove the above extra portion. The order of the quenching step and the cutting step may be reversed.

By adopting such manufacturing steps, it is possible to eliminate the need to perform the quenching process on the above welding expected portion, and to remove a portion of the welding expected portion with a carbon concentration increased through the carburizing step together with the above extra portion in the above cutting step. Therefore, it is possible to completely omit an anti-carburizing process and an anti-carburizing agent removal process which are performed in the related art to provide the welding expected portion, and to reduce the number of man-hours and the amount of energy used for such processes.

By locally performing the above quenching step which uses high-density energy, it is possible to obtain the above carburized quenched portion which has excellent wear resistance and high hardness on the surface and which has excellent toughness in the inner portion while suppressing generation of distortion.

By performing the above cooling step, in which the intermediate product is not cooled rapidly but cooled at a restricted cooling rate, after the above carburizing step, it is possible to suppress cooling distortion in the overall shape of the above first steel part, and to maintain good dimensional accuracy.

Thus, according to the above manufacturing method, in obtaining the above first steel part, it is possible to achieve a sufficient effect of improving the surface hardness of the part that requires wear resistance, to improve the weldability of the welding expected portion more than ever, and to completely abolish the anti-carburizing process during manufacture.

In the subsequent welding step, as described above, welding is performed at the welding expected portion with good weldability. Therefore, a composite steel part with excellent welding strength can be obtained.

The composite steel part according to the above second aspect can be easily manufactured by applying the above manufacturing method, for example. The cylindrical portion formed by the carburized quenched portion having the above specific structure demonstrates excellent wear resistance, and the welded portion of the above flange portion having the specific structure provides excellent characteristics.

DETAILED DESCRIPTION OF THE EMBODIMENTS

Figure 1:
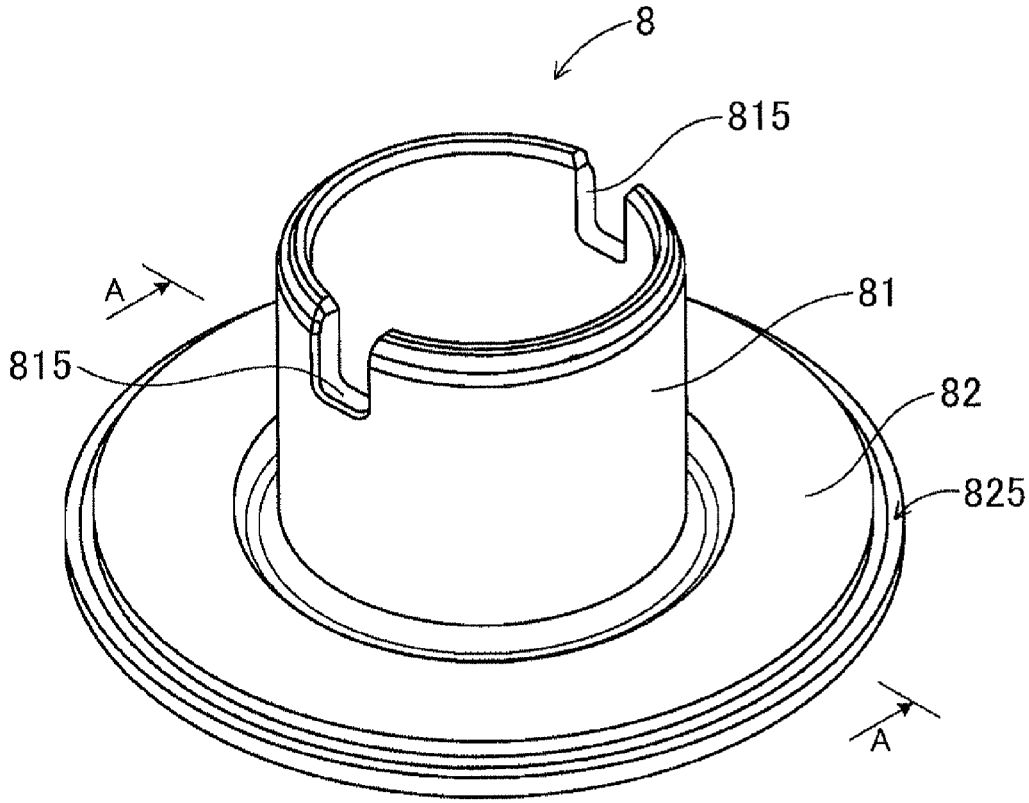
FIG. 1 is a perspective view of a first steel part according to a first embodiment.

In the manufacturing method for the above composite steel part, the above carburizing step is preferably performed in a low-oxygen carburizing atmosphere in which the oxygen concentration is lower than that in the atmosphere. Specifically, the method may be performed in a decompressed carburizing gas, the pressure of which has been reduced to be lower than the atmospheric pressure, for example. That is, it is effective to adopt a decompressed carburizing step. In the decompressed carburizing step, the carburizing process can be performed using a relatively small amount of the carburizing gas while maintaining the inside of a carburizing furnace at a high temperature in a decompressed state. Thus, the carburizing process can be performed more efficiently than in the related art. In addition, a heating process performed in the related art over a long time using a large heat treatment furnace is no longer necessary. Thus, it is possible to reduce processing time, energy consumption, and further the size of the carburizing/quenching apparatus itself.

By adopting the decompressed carburization, it is possible to reduce the pressure of the carburizing atmosphere in the carburizing step compared to the atmospheric pressure, which suppresses the amount of oxygen in the atmosphere to be low. This prevents intergranular oxidation of the carburized layer.

The method for carburization performed in a carburizing atmosphere, the oxygen concentration of which is lower than the atmosphere, is not limited to the decompressed carburization described above. For example, a nitrogen gas or an inert gas may be charged, rather than reducing the pressure of the atmosphere, to suppress the amount of oxygen in the atmosphere to be low to prevent intergranular oxidation of the carburized layer.

The above decompressed carburization is also referred to as vacuum carburization, and is a carburizing process performed with the pressure of the atmosphere in the furnace reduced and with a hydrocarbon gas (such as methane, propane, ethylene, and acetylene, for example) directly introduced into the furnace as the carburizing gas. In general, a decompressed carburizing process includes a carburizing period in which activated carbon generated as a carburizing gas contacts a surface of steel to be decomposed becomes a carbide on the surface of the steel to be accumulated in the steel, and a diffusion period in which the carbide is decomposed so that the accumulated carbon is dissolved in a matrix to be diffused inward. It is said that the carbon is not only supplied by way of the carbide, but also directly dissolved in the matrix.

In addition, the above carburizing step is preferably performed under a decompression condition at 1 to 100 hPa. In the case where the pressure during the carburization in the decompressed carburizing step is reduced to be less than 1 hPa, an expensive apparatus may be required to maintain the degree of vacuum. In the case where the pressure exceeds 100 hPa, on the other hand, soot may be generated during the carburization to cause unevenness in carburization concentration.

As the above carburizing gas, hydrocarbon gases such as acetylene, propane, butane, methane, ethylene, and ethane, for example, may be used.

As the steel raw material for the above steel part, low-carbon steel or low-carbon alloy steel with a carbon content equal to or less than about 0.30% by mass is preferably used. In particular, use of low-carbon steel with little added alloy elements is preferred in terms of cost and reducing the amount of consumption of rare elements. Also when such low-carbon steel is used as a raw material, a composite steel part with excellent characteristics as described above can be obtained by adopting the above manufacturing method.

[Embodiment]

(First Embodiment)

The composite steel part and the manufacturing method for the composite steel part described above according to an embodiment will be described with reference to the drawings.

Figure 2:
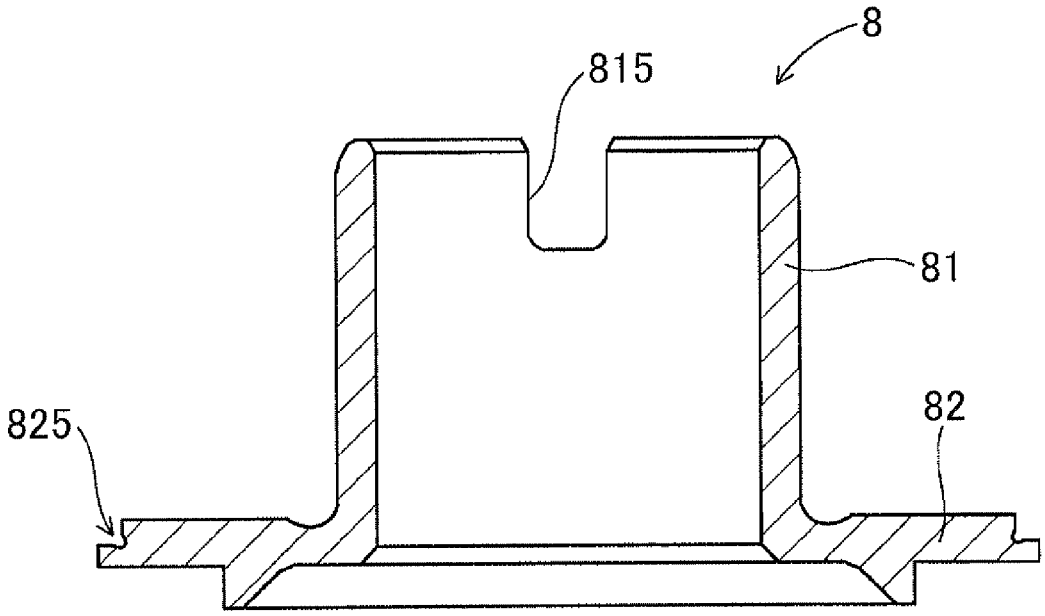
FIG. 2 is a cross-sectional view of the first steel part according to the first embodiment (a cross-sectional view taken along the line A-A of FIG. 1)

As shown in FIGS. 1 and 2, a first steel part 8 manufactured in the embodiment is a steel part to be incorporated in an automotive automatic transmission and including a cylindrical portion 81 formed in a cylindrical shape and a flange portion 82 provided to extend radially outward from one end of the cylindrical portion 81. In the first steel part 8, the cylindrical portion 81 is a carburized quenched portion which has been subjected to a carburizing quenching hardening process, and the flange portion 82 includes a welding expected portion 825 to be welded to a second steel part. The other end of the above cylindrical portion 81 is provided with two notched portions 815 arranged in the circumferential direction.

Figure 3:
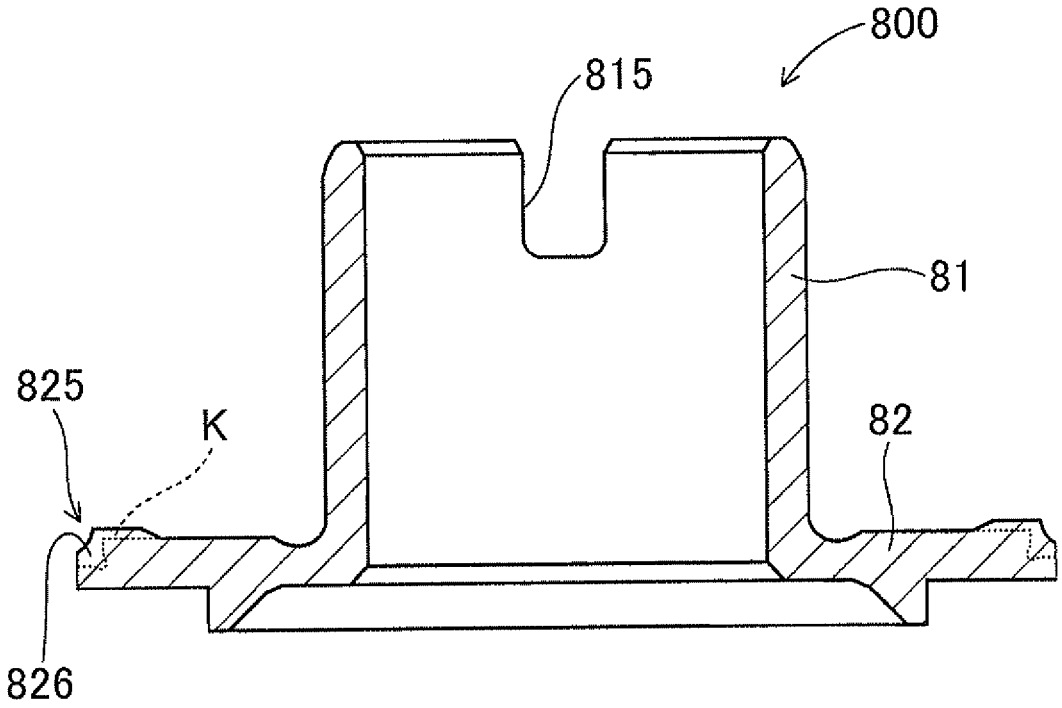
FIG. 3 is a cross-sectional view of an intermediate member according to the first embodiment.

In order to manufacture such a first steel part 8, first, an intermediate product 800 is prepared through a hot forging step and a cutting step using low-carbon steel with a carbon content of 0.15% by mass as a raw material. In the intermediate product 800, as shown in FIG. 3, the welding expected portion 825 is shaped by adding an extra portion 826 with a thickness equal to or more than that of a carburized layer to be formed in a subsequent carburizing step to a final desired shape indicated by the broken line K.

Next, a carburizing step, in which the intermediate product 800 is heated to an austenitizing temperature or more in a carburizing atmosphere to form a carburized layer on a surface of the intermediate product 800, is performed.

Next, subsequent to the carburizing step, a cooling step, in which the intermediate product 800 is cooled at a cooling rate less than a cooling rate at which martensitic transformation is caused and in which the intermediate product 800 is cooled to a temperature equal to or less than a temperature at which structure transformation due to the cooling is completed, is performed.

Next, a quenching step, in which the entire cylindrical portion 81 which is to become the carburized quenched portion of the intermediate product 800 is heated to an austenitizing range by high-density energy and thereafter cooled at a cooling rate equal to or more than the cooling rate at which martensitic transformation is caused, is performed.

After that, a cutting step, in which the welding expected portion 825 of the intermediate product 800 is cut into a final desired shape, is performed. The cutting step and the quenching step described above may be reversed in order.

Further description follows.

First, a heat treatment apparatus 5 that performs the carburizing to quenching steps on the above intermediate product 800, specific heat treatment conditions, and so forth will be briefly described.

Figure 7:
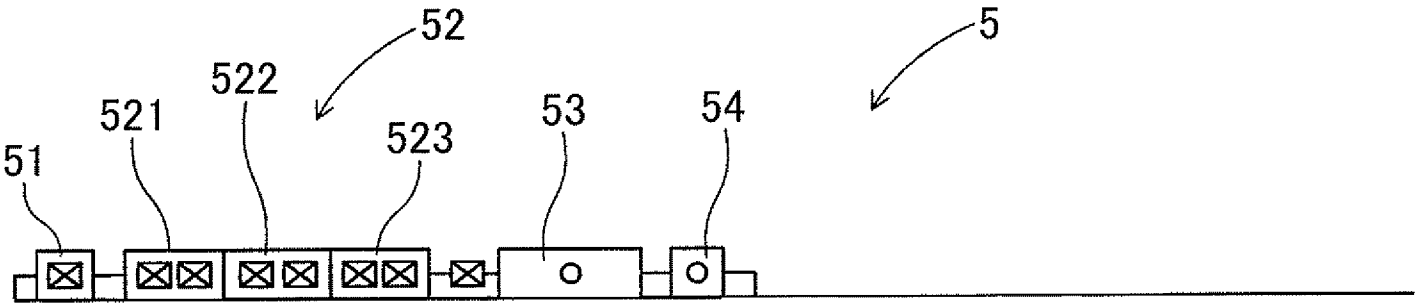
FIG. 7 is an illustration showing the configuration of a heat treatment apparatus according to the first embodiment.

As shown in FIG. 7, the heat treatment apparatus 5 includes a pre-wash bath 51 for washing the steel part before the carburizing quenching process, a decompressed carburizing/slow-cooling device 52 including a heating chamber 521, a decompressed carburizing chamber 522, and a decompressed slow-cooling chamber 523, a high-frequency quenching machine 53, and a magnetic flaw detection device 54 for inspection for a defect.

Figure 8:
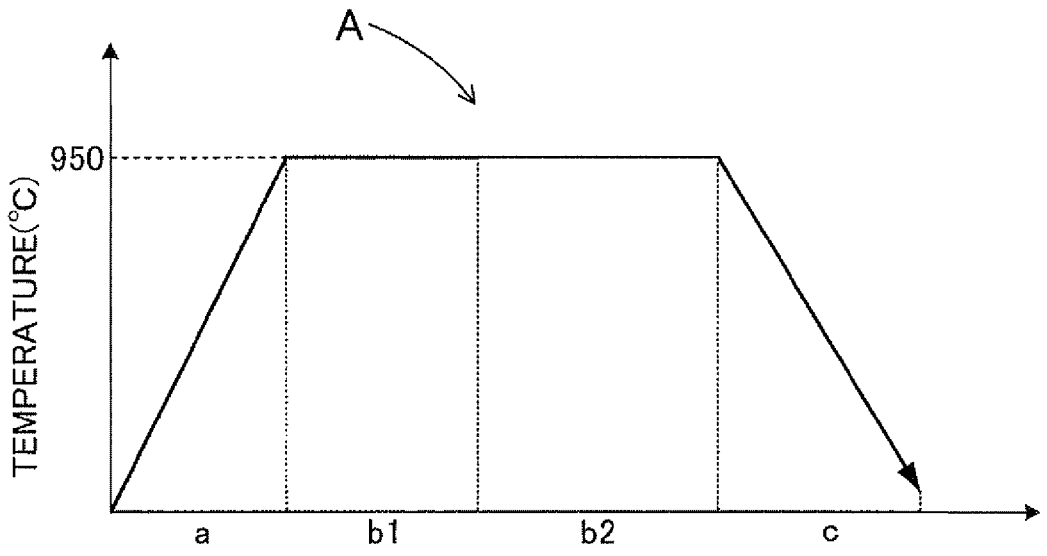
FIG. 8 is an illustration showing a heat pattern for the carburizing step and a cooling step according to the first embodiment.

The carburizing step according to the embodiment performed using the heat treatment apparatus 5 is a decompressed carburizing step performed in a decompressed carburizing gas, the pressure of which has been reduced to be lower than the atmospheric pressure. FIG. 8 shows a heat pattern A for use in the step. In the drawing, the horizontal axis and the vertical axis represent the time and the temperature, respectively.

As seen from the drawing, in the heat pattern A for the carburizing step, the temperature is raised to a carburizing temperature in a heating period a, and then kept constant in holding periods b1 and b2. The temperature is kept constant at 950° C., which is a temperature equal to or more than the austenitizing temperature. The first one, b1, of the holding periods corresponds to the carburizing period of the carburizing process, and the second one, b2, of the holding periods corresponds to the diffusion period of the carburizing process. The decompression condition for the decompressed carburizing process is defined as 1 to 3.5 hPa, and acetylene is used as the carburizing gas in the period b1 corresponding to the above carburizing period.

After the diffusion period of the decompressed carburizing process is ended, a cooling period c corresponding to the cooling step is entered. In the embodiment, a decompressed slow-cooling step is adopted, and the decompression condition for the decompressed slow-cooling step is defined as 600 hPa. Nitrogen ($N_2$) is used as a cooling atmosphere gas. The cooling rate for the decompressed slow-cooling step is set in the range of 0.1 to 3.0° C./second during a period over which the temperature is reduced from a temperature equal to or more than the austenitizing temperature immediately after the carburizing process to a temperature of 150° C. which is lower than an A1 transformation point. The heat pattern A and other conditions described here are merely illustrative, and may be changed to conditions optimum for the steel part to be processed through a preliminary test or the like as appropriate.

Figure 9:
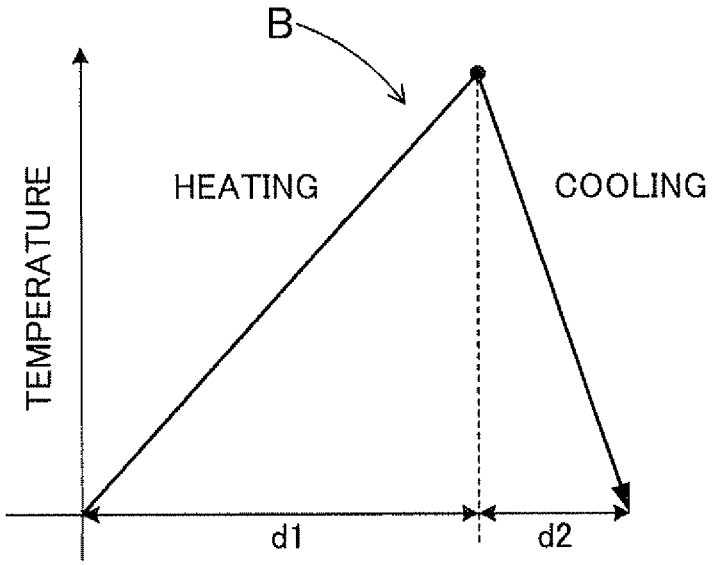
FIG. 9 is an illustration showing a heat pattern for the quenching step according to the first embodiment.

In the quenching step according to the embodiment performed after the cooling step, high-frequency heating is used as heating means, and water cooling is used as rapid-cooling means. A heat pattern B for the quenching step is shown in FIG. 9. In the drawing, the horizontal axis and the vertical axis represent the time and the temperature, respectively. As shown in the drawing, the quenching step according to the embodiment includes a heating period d1 in which the entire cylindrical portion 81 is heated through high-frequency heating to a temperature equal to or more than the austenitizing temperature, and a subsequent rapid-cooling period d2 in which the cylindrical portion 81 is water-quenched by injection of water or cooling water containing an anti-quenching crack agent so that a cooling rate equal to or more than a rapid-cooling critical cooling rate at which martensitic transformation is caused in the carburized layer can be easily obtained. The heat pattern B may be changed to a condition optimum for the steel part to be processed through a preliminary test or the like as appropriate.

Next, changes in state of structure of various portions of the intermediate product 800 and the first steel part 8 over the above steps will be described.

First, in the intermediate product 800, as shown in FIG. 3, the welding expected portion 825 is shaped with the extra portion 826 added. The internal structure of the intermediate product 800 before the carburizing step is a state of structure after plastic forming, as with that of a normal steel part after hot forging. When the carburizing step is performed, the entire intermediate product 800 is transformed into an austenite structure. At this time, a surface layer portion of the intermediate product 800 has been transformed into a carburized layer 88 (see FIG. 4) with a high carbon concentration in which the carbon concentration is higher than that of the base material.

Figure 4:
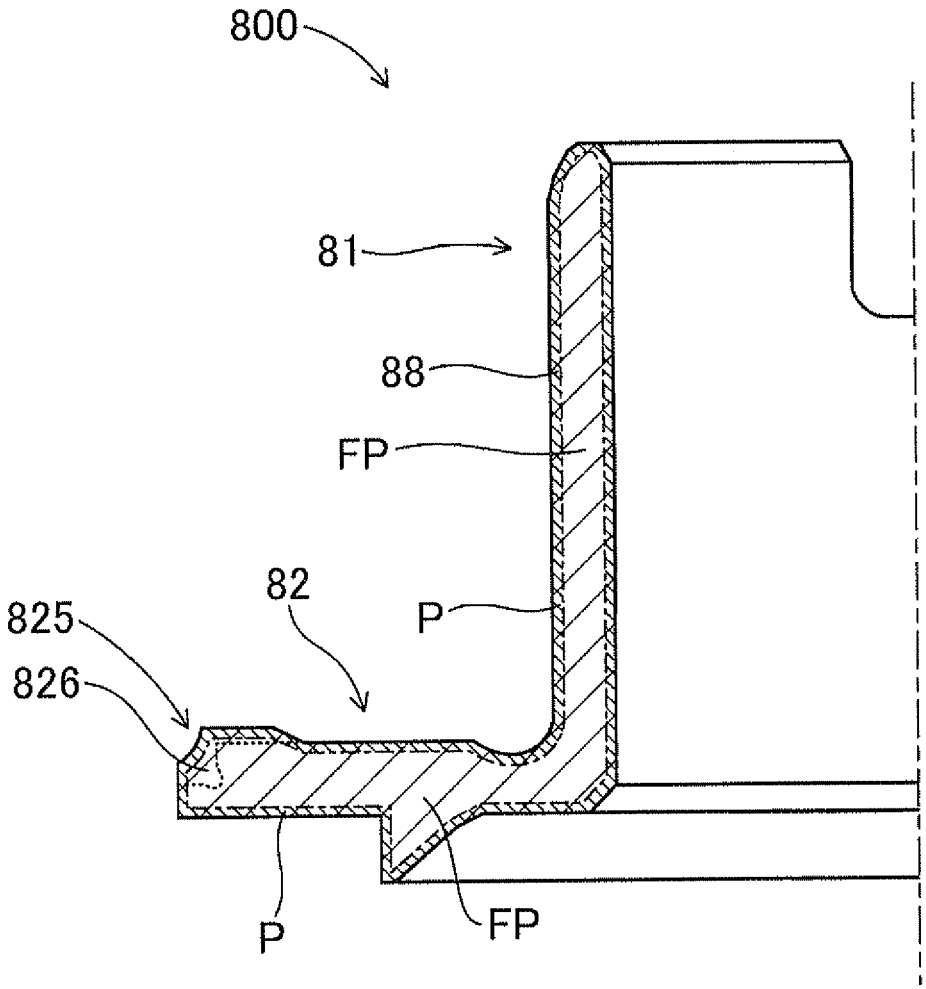
FIG. 4 is an illustration showing the state of structure immediately after a carburizing step according to the first embodiment.

Then, as shown in FIG. 4, the intermediate product 800 with the austenite structure is subjected to the subsequent decompressed slow-cooling step so that a portion of the intermediate product 800 other than the carburized layer 88 is transformed into a ferrite-pearlite structure FP and the carburized layer 88 forming the surface layer is transformed into a pearlite structure P.

Figure 5:
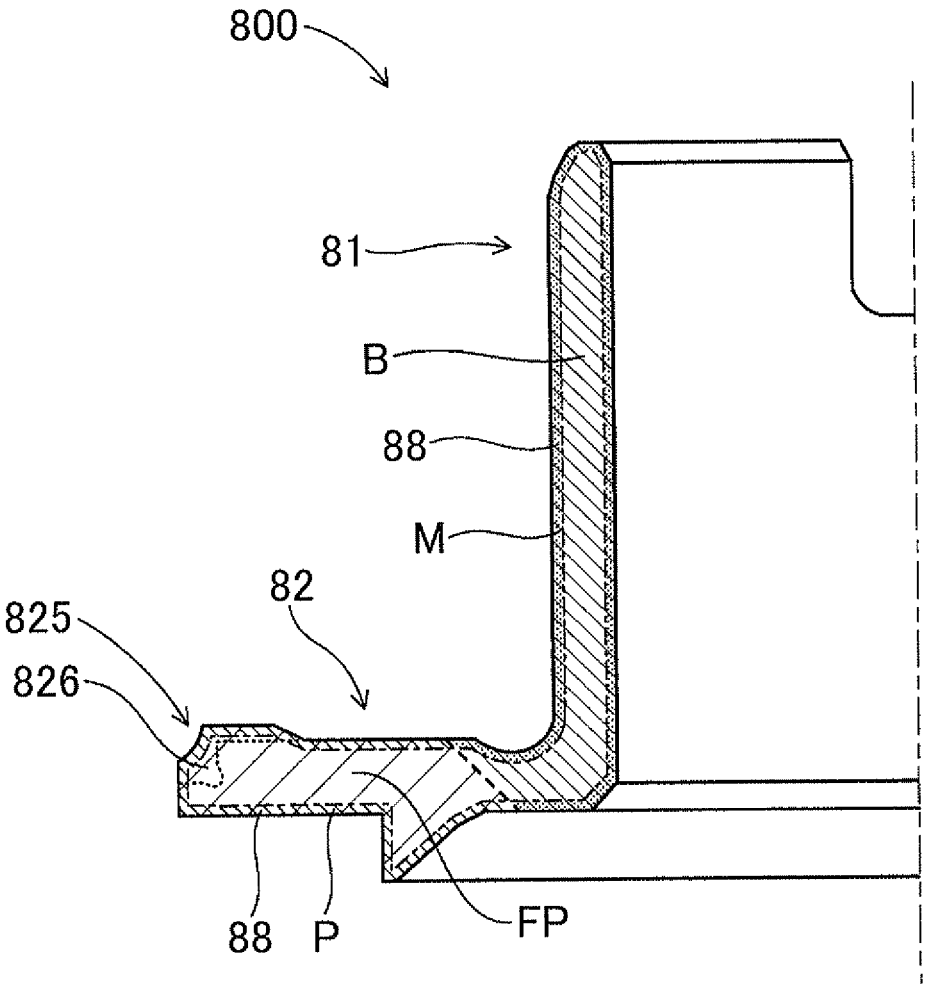
FIG. 5 is an illustration showing the state of structure immediately after a quenching step according to the first embodiment.

Next, the cylindrical portion 81 of the intermediate product 800 is heated through high-frequency heating to be transformed into an austenite structure. When water cooling is performed thereafter, as shown in FIG. 5, the carburized layer 88 is transformed into a martensite structure M, and an inner portion of the cylindrical portion 81 is transformed into a bainite structure B. In the flange portion 82 which is not subjected to the quenching step, on the other hand, the carburized layer 88 forming the surface layer is maintained in the pearlite structure P, and an inner portion of the flange portion 82 is maintained in the ferrite-pearlite structure FP.

After that, the welding expected portion 825 of the flange portion 82 of the intermediate product 800 is subjected to the cutting step to remove the extra portion 826 including the carburized layer 88. This results in the first steel part 8 in the final shape. The ferrite-pearlite structure FP is exposed in the welding expected portion 825 of the first steel part 8. In order to improve the product quality, it is effective to perform a polishing process, a grinding process, or the like before or after the cutting step to further improve the overall dimensional accuracy and perform washing at the end.

Next, the hardness characteristics and the weldability of various portions of the obtained first steel part 8 were evaluated. For comparison, a comparative part 9 obtained by the manufacturing method according to the related art was prepared.

Figure 10:
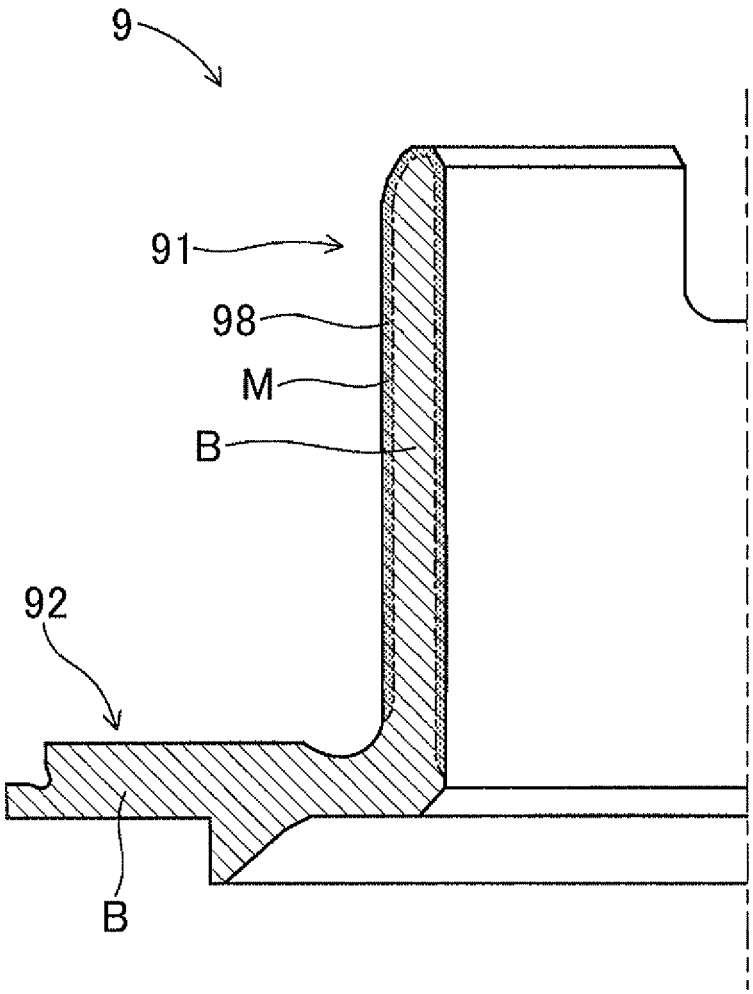
FIG. 10 is an illustration showing the state of structure of a comparative part.

In the comparative part 9, an anti-carburizing process in which a surface of a flange portion 92 is covered with an anti-carburizing agent is performed, and thereafter a carburizing quenching process is performed. After that, shot blasting is performed to remove the anti-carburizing agent, and further a finishing process such as polishing is performed. In the comparative part 9, as shown in FIG. 10, a surface layer of a cylindrical portion 91 which is not subjected to the anti-carburizing process is a carburized layer 98 having a martensite structure M, and an inner portion of the cylindrical portion 91 and the entire flange portion 92 have a bainite structure B.

The hardnesses of various portions of the first steel part 8 and the comparative part 9 were measured in cross section.

Figure 6:
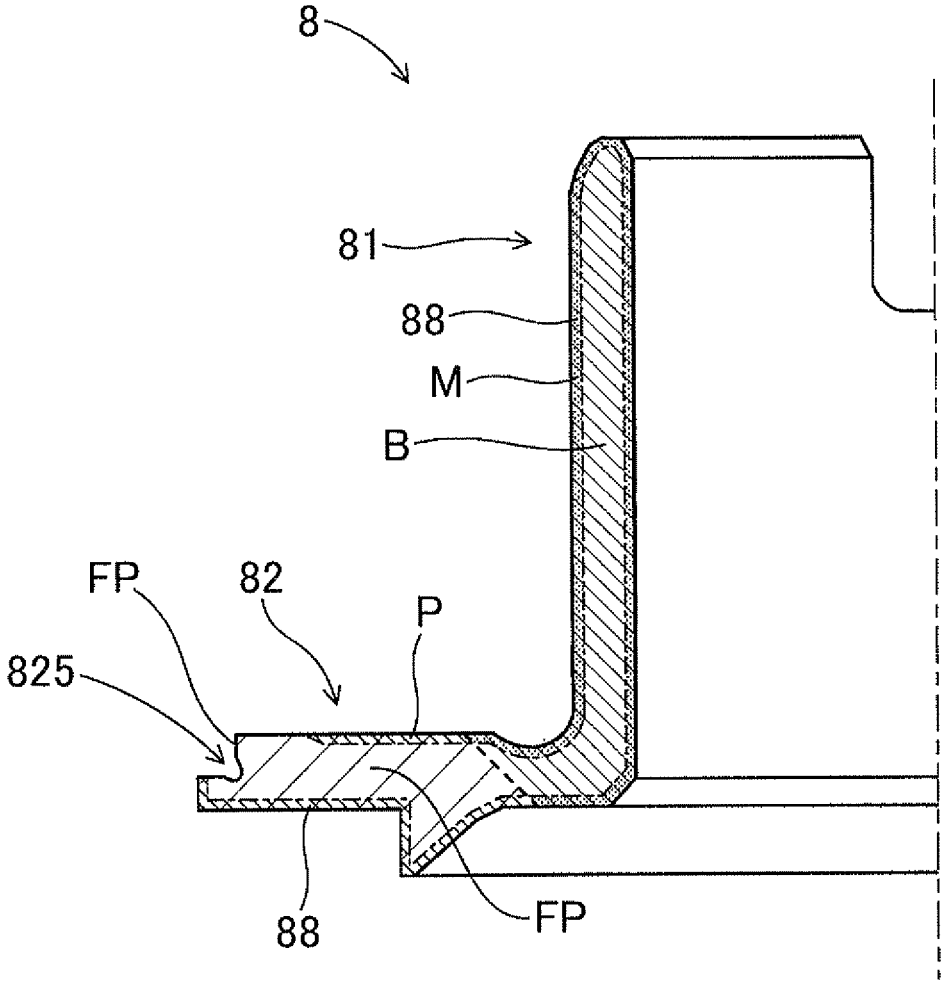
FIG. 6 is an illustration showing the state of structure after a cutting step according to the first embodiment.

The martensite structure M in the carburized layer 88 (FIG. 6) of the cylindrical portion 81 of the first steel part 8 had a Vickers hardness in the range of 756 to 820 HV, and was found to be significantly hard. The bainite structure B in the inner portion of the cylindrical portion 81 of the first steel part 8 had a Vickers hardness in the range of 331 to 459 HV, and was found to have moderate hardness and also excellent toughness. Further, the ferrite-pearlite structure FP in the flange portion 82 of the first steel part 8 including the welding expected portion 825 had a Vickers hardness in the range of 154 to 163 HV, and had relatively low hardness. On the other hand, the pearlite structure P in the carburized layer 88 farming the surface layer of the flange portion 82 had slightly higher hardness, and had a Vickers hardness in the range of 298 to 311 HV.

In the comparative part 9, in contrast, the martensite structure M in the carburized layer 98 (FIG. 10) of the cylindrical portion 91 had a Vickers hardness in the range of 765 to 787 HV, and had significantly high hardness. The bainite structure B in the inner portion of the cylindrical portion 91 and in the entire flange portion 92 of the comparative part 9 had a Vickers hardness in the range of 282 to 332 HV.

Through comparison between the above comparative part 9 and the first steel part 8 according to the embodiment, it was found that the cylindrical portion 81 of the first steel part 8 had a surface hardness comparable to that of the comparative part 9 and maintained significantly excellent wear resistance characteristics.

Figure 11:
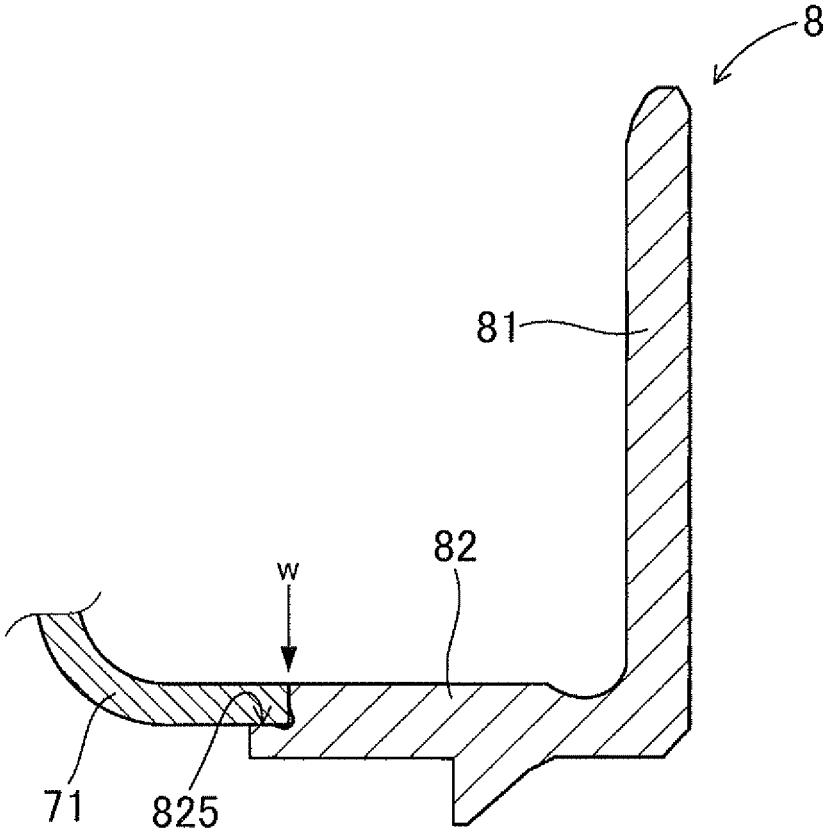
FIG. 11 is an illustration showing a position at which the first steel part and a second steel part are welded to each other according to the first embodiment.

Next, the weldability of the first steel part 8 and the comparative part 9 was evaluated. Specifically, as shown in FIG. 11, a second steel part 71 to be welded to the welding expected portion 825 was prepared, and actually arc-welded to a location for welding W to obtain a composite steel part 75. Then, a welded portion 750 was subjected to a sleeve welding strength verification test (in which the strength of the welded portion was measured with a load applied to the location of welding) and a leak test.

As a result of the sleeve welding strength verification test, it was found that the first steel part 8 achieved a welded portion strength equal to or more than that of the comparative part 9. In addition, both the first steel part 8 and the comparative part 9 caused no problem in the leak test. From the test results, it was found that the weldability of the first steel part 8 was equal to or more than that of the comparative part 9.

Figure 12:
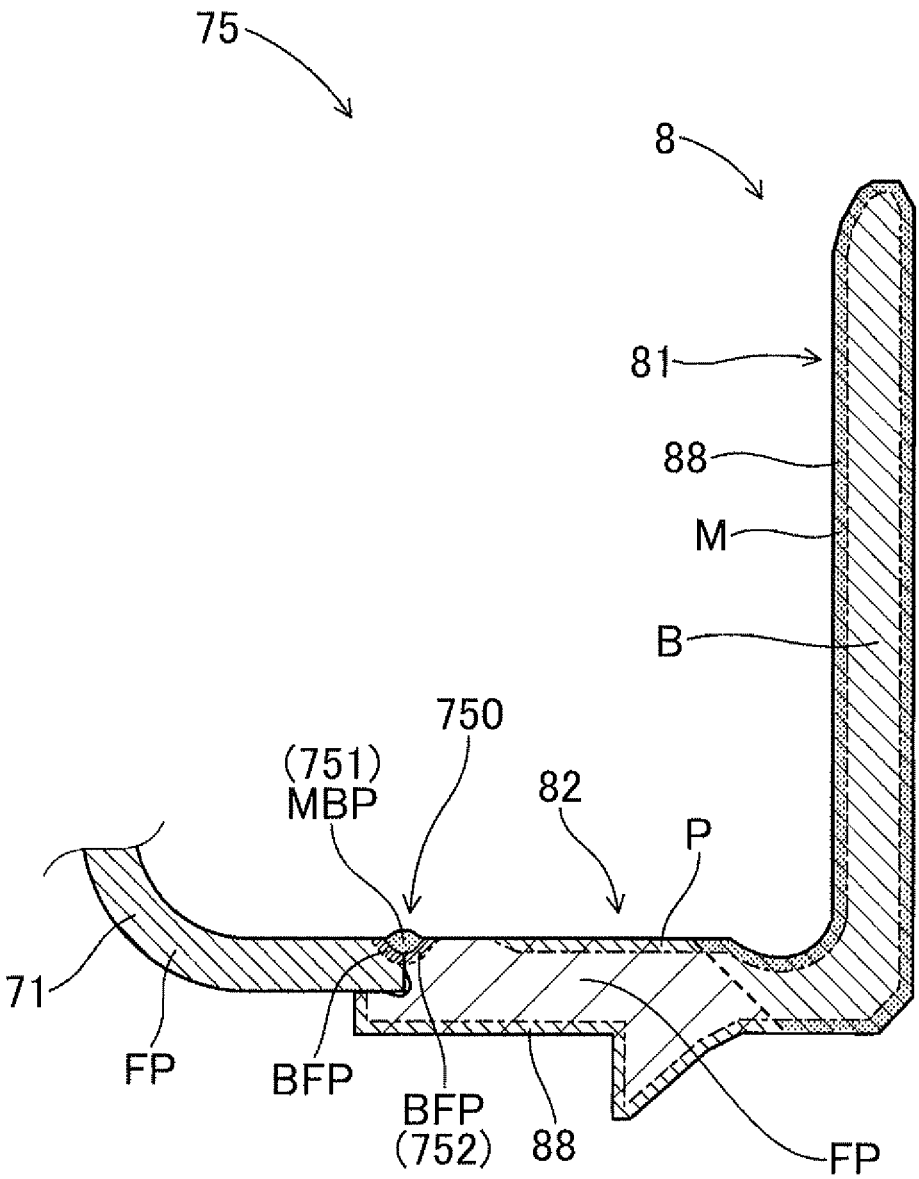
FIG. 12 is an illustration showing the state of structure of a welded portion between the first steel part and the second steel part according to the first embodiment.

As shown in FIG. 12, the welded portion 750 of the composite steel part 75 fabricated from the first steel part 8 and the second steel part 71 includes a melt/resolidificated portion 751 and a heat-affected portion 752 provided adjacent to the melt/resolidificated portion 751. The melt/resolidificated portion 751 has a martensite-bainite-pearlite structure MBP, that is, a structure in which a martensite structure, a bainite structure, and a pearlite structure are mixed with each other. Meanwhile, the heat-affected portion 752 has a bainite-ferrite-pearlite structure BFP, that is, a structure in which a bainite structure, a ferrite structure, and a pearlite structure are mixed with each other. A portion surrounding the heat-affected portion 752 has a ferrite-pearlite structure FP as with the original welding expected portion 825. The remaining portion of the first steel part 8 is not changed in structure from what it was before the welding step. A portion of the second steel part 71 surrounding the welded portion 750 has a ferrite-pearlite structure FP.

Figure 13:
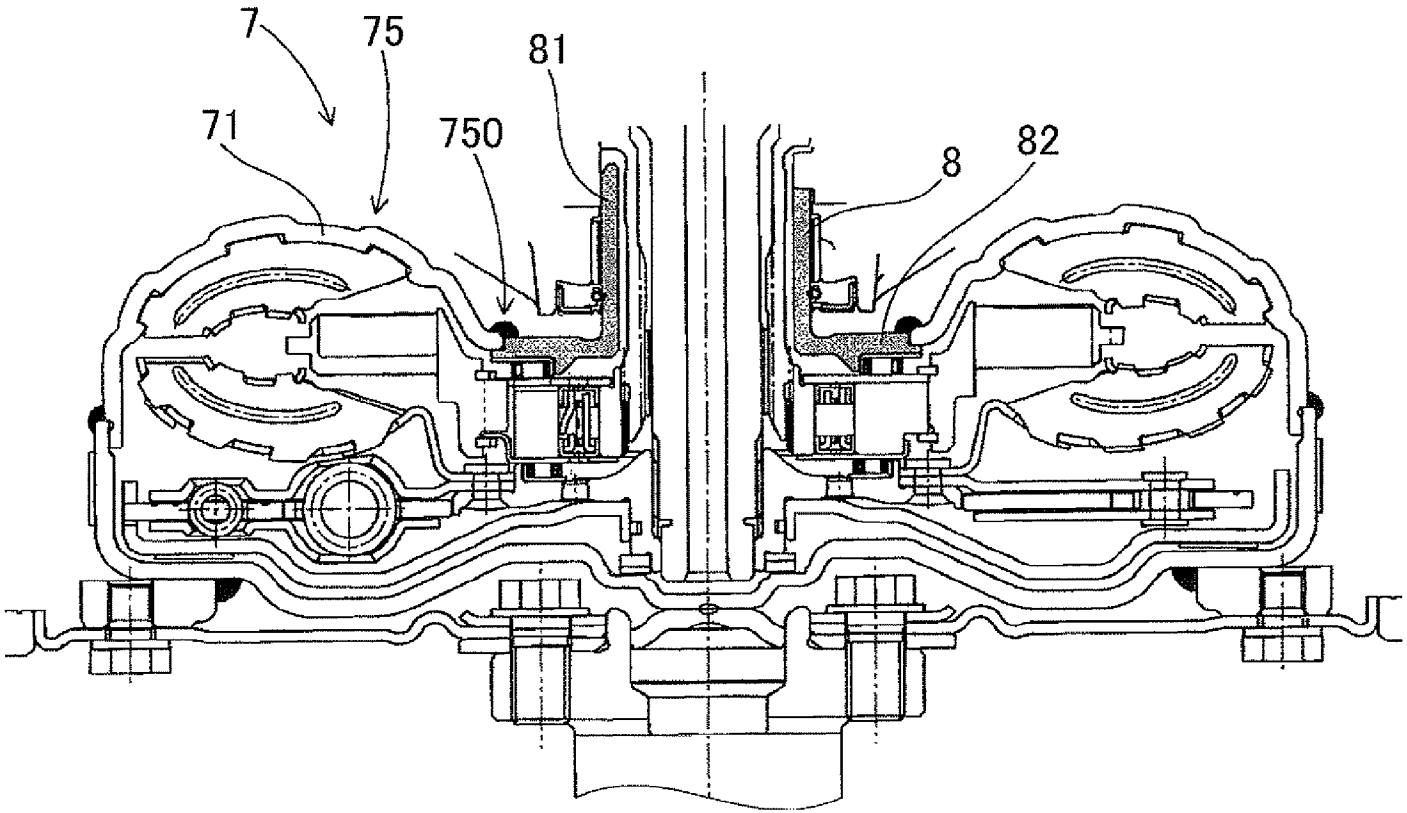
FIG. 13 is an illustration showing the configuration of an assembled part incorporating a composite steel part formed by welding the first steel part and the second steel part to each other according to the first embodiment.

FIG. 13 shows an assembled part 7 incorporating the composite steel part 75 formed by coupling the second steel part 71 and the first steel part 8 described above to each other via the welded portion 750. The assembled part 7 is a torque converter (T/C) to be incorporated into an automotive automatic transmission. The first steel part 8 is a part of the assembled part 7 called pump impeller hub. Excellent wear resistance is required for the cylindrical portion 81, and excellent weldability with a pump shell formed by the second steel part 71 is desired for the flange portion 82. For such usage, the composite steel part 75 formed by welding the first steel part 8 according to the above embodiment and the second steel part 71 to each other sufficiently provides required qualities, and demonstrates excellent performance. The first steel part 8 is not limited to use as a pump impeller hub, and may be used as any part that includes a cylindrical portion and a flange portion. For example, the first steel part 8 may be used as a power transfer shaft such as an input shaft and an output shaft of an automotive automatic transmission.

What is claimed is:

1. A manufacturing method for a composite steel part formed by welding a plurality of steel parts to each other, comprising:

manufacturing a first steel part, which includes a cylindrical portion formed in a cylindrical shape and a flange portion provided to extend radially outward from one end of the cylindrical portion, the cylindrical portion being a carburized quenched portion which has been subjected to a carburizing quenching hardening process and the flange portion including a welding expected portion to be welded to a second steel part, by preparing an intermediate product in which an extra portion, which has a thickness equal to or more than that of a carburized layer to be formed in a subsequent carburizing step, has been added to the welding expected portion, and performing the carburizing step in which the intermediate product is heated to an austenitizing temperature or more in a carburizing atmosphere to form the carburized layer on a surface of the intermediate product, a cooling step, subsequent to the carburizing step, in which the intermediate product is cooled at a cooling rate less than a cooling rate at which martensitic transformation is caused and in which the intermediate product is cooled to a temperature equal to or less than a temperature at which structure transformation due to the cooling is completed, a quenching step in which a desired portion of the cylindrical portion of the inteimediate product is heated to an austenitizing range by high-frequency heating and thereafter cooled at a cooling rate equal to or more than the cooling rate at which martensitic transformation is caused to form the carburized quenched portion in the desired portion, and a cutting step in which the extra portion of the intermediate product is cut; and then performing a welding step in which the second steel part is brought into abutment with the welding expected portion of the flange portion of the obtained first steel part to weld the first steel part and the second steel part to each other.

2. A composite steel part formed by welding a plurality of steel parts to each other, the composite steel part being manufactured by a method of claim 1, wherein:

a first steel part includes a cylindrical portion formed in a cylindrical shape and a flange portion provided to extend radially outward from one end of the cylindrical portion;

the cylindrical portion is formed by a carburized quenched portion in which a surface layer portion has a martensite structure and an inner portion has a bainite structure;

the flange portion includes a welded portion welded to a second steel part;

the welded portion includes a melt/resolidificated portion and a heat-affected portion provided adjacent to the melt/resolidificated portion; and the melt/resolidificated portion has a martensite-bainite-pearlite structure, and the heat-affected portion has a bainite-ferrite-pearlite structure.

* * * * *